US006280487B1

(12) United States Patent
Schulz et al.

(10) Patent No.: US 6,280,487 B1
(45) Date of Patent: Aug. 28, 2001

(54) PROCESS FOR PREPARING IGNITION PROMOTER, AND FUEL CONTAINING AN IGNITION PROMOTER

(75) Inventors: Johann G. Schulz; Engelina Porowski, both of Pittsburgh, PA (US)

(73) Assignee: JGS Research Company, Inc., Pittsburgh, PA (US)

( * ) Notice: Subject to any disclaimer, the term of this patent is extended or adjusted under 35 U.S.C. 154(b) by 0 days.

(21) Appl. No.: 08/189,899

(22) Filed: Jan. 31, 1994

Related U.S. Application Data

(63) Continuation-in-part of application No. 07/816,099, filed on Dec. 24, 1991, now abandoned.

(51) Int. Cl.[7] ..... C10L 1/22; C10L 1/18
(52) U.S. Cl. ..... 44/326; 536/115; 536/17.7
(58) Field of Search ..... 44/313, 324, 326; 536/115, 17.7

(56) References Cited

U.S. PATENT DOCUMENTS

| | | | | |
|---|---|---|---|---|
| 1,121,203 | | 12/1914 | Rigby et al. . | |
| 1,145,095 | | 7/1915 | Testrup et al. . | |
| 1,262,267 | * | 4/1918 | Schaub | 44/313 |
| 4,052,448 | | 10/1977 | Schulz et al. | 260/515 H |
| 4,053,645 | | 10/1977 | Jelks | 426/53 |
| 4,266,027 | | 5/1981 | Muller et al. | 435/99 |
| 4,266,981 | | 5/1981 | Tsao et al. | 127/37 |
| 4,448,587 | | 5/1984 | Hinkamp et al. | 44/57 |
| 4,448,881 | | 5/1984 | Muller et al. | 435/162 |
| 4,465,028 | * | 8/1984 | Waniczek | 44/313 |
| 4,473,378 | * | 9/1984 | Hanlon et al. | 44/324 |
| 4,549,883 | | 10/1985 | Purcell et al. | 44/57 |
| 4,659,335 | * | 4/1987 | Wegner | 44/313 |
| 4,668,243 | | 5/1987 | Schulz | 44/1 R |
| 4,705,534 | * | 11/1987 | Yan | 44/313 |
| 5,096,462 | * | 3/1992 | Schulz et al. | 44/313 |

FOREIGN PATENT DOCUMENTS 0080314 6/1983 (EP) .

OTHER PUBLICATIONS

The Merck Index, Tenth Edition, Windholz et al., Merck & Co., Inc., New Jersey, 1983, p. 550.
The Chemical Process Industries, Shreve, 2nd Edition, McGraw–Hill Book Co., Inc., N.Y., 1956, pp. 944–945.
Windholz et al, The Merck Index, 10$^{th}$ Edition, Merck & Co. Inc. N.J., 1983, p. 1273, 8756 Sucrose.*

* cited by examiner

*Primary Examiner*—Margaret Medley
(74) *Attorney, Agent, or Firm*—Roylance, Abrams, Berdo & Goodman, L.L.P.

(57) ABSTRACT

A process for preparing the ignition promoter comprises combining a sugar with selected solvents and heating to form a stable solution, reacting the resulting solution with an oxirane and thereafter reacting the resulting product with nitric acid under nitrating conditions. A fuel for use in compression ignition engines contains a lower alcohol and about 0.15 to 30 wt % of the ignition promoter.

25 Claims, No Drawings

PROCESS FOR PREPARING IGNITION PROMOTER, AND FUEL CONTAINING AN IGNITION PROMOTER

CROSS-REFERENCE TO RELATED APPLICATION

This application is a continuation-in-part of application Ser. No. 07/816,099 filed Dec. 24, 1991 now abandoned.

FIELD OF THE INVENTION

This invention relates to a novel ignition promoter and to a process for preparing the ignition promoter. More particularly, the invention is directed to a process of preparing ignition promoters by combining at least one sugar with polar solvents in the presence of acid catalysts to produce stable solutions, reacting these solutions with an oxirane and thereafter reacting the product obtained with nitric acid under nitrating conditions.

BACKGROUND OF THE INVENTION

There is much interest in developing alternate fuels for internal combustion engines and the like. There is particular interest in ignition promoters for compression-ignition engines, for example, diesel engines, due to the high cost and uncertain availability of petroleum based fuels and environmental concerns. Among potential fuels that have received considerable attention, especially for diesel engines, are the lower alcohols, such as methanol, ethanol, etc. Methanol is of particular interest since it can easily be obtained from natural gas as well as form the large coal reserves available in many Western countries. Unfortunately, methanol or ethanol alone have poor compression-ignition characteristics making them unsuitable for use in conventional diesel engines. It is known however that ignition promoters can be added to lower alcohols to make them suitable for use in diesel engines.

U.S. Pat. No. 5,096,462, which is hereby incorporated by reference, discloses that effective ignition promoters suitable for incorporation into alcohols produce excellent fuels for use in internal combustion engines. The ignition promoters are obtained by removing cellulose from biomass, using any suitable procedure therefor, reacting the remainder of said biomass with an oxirane and thereafter reacting the resulting reaction product with nitric acid under nitrating conditions.

We have now discovered an exceeding simple process for producing an ignition promoter that can be introduced into an alcohol to obtain a fuel suitable for use in internal combustion engines, in particular compression-ignition engines, that involves combining a sugar with a selected solvent, reacting the resulting solution with an oxirane and thereafter reacting the product obtained with nitric acid under nitrating conditions.

SUMMARY OF THE INVENTION

The present invention is directed to a process for preparing an ignition promoter by reacting a sugar in a suitable solvent with an oxirane, recovering the resulting product and nitrating the product. The nitrated product is particularly suitable as an ignition promoter in lower alcohol fuels.

Accordingly, a primary aspect of the invention is to provide an efficient process for producing an ignition promoter and fuels containing the ignition promoters. The ignition promoter produced by the process is particularly desirable as an ignition promoter in lower alcohol fuels to make the fuels suitable for use in compression-ignition engines.

The ignition promoter is prepared by initially dispersing a sugar in a polar solvent with an acid catalyst and heating the dispersion under elevated pressure in an autoclave. In preferred embodiments, the sugar is a disaccharide, such as sucrose, which when heated under elevated pressure in the presence of an acid in methanol, reacts and forms a solution.

These and other aspects of the invention are basically attained by providing a process for preparing an ignition promoter comprising dispersing a sugar and an acid catalyst in a polar solvent to form a dispersion; heating the dispersion at a sufficient temperature to form a first reaction product in the form of a solution; reacting the first reaction product with an oxirane to form a second reaction product; recovering the second reaction product of the first reaction product and oxirane; nitrating the recovered second reaction product with nitric acid to produce a nitro-ester compound; and recovering the nitro-ester compound.

Further aspects of the invention are provided by producing a fuel comprising at least one $C_1$–$C_6$ alkyl alcohol; and an ignition promoter prepared by the process of dispersing a sugar and an acid catalyst in a polar solvent to form a dispersion; heating the dispersion at a sufficient temperature to form a first reaction product; reacting the first reaction product solution with an oxirane to form a second reaction product; recovering the second reaction product of the first reaction product and oxirane; nitrating the recovered second reaction product with nitric acid to produce a nitro-ester compound; and recovering the nitro-ester compound.

DETAILED DESCRIPTION OF THE INVENTION

The invention is directed to an ignition promoter and, more particularly, to a process of preparing the ignition promoter. The process essentially comprises dissolving or dispersing a sugar in a polar solvent with an acid catalyst and heating the dispersion. In preferred embodiments, the dispersion is heated in an autoclave under elevated pressure to produce a first reaction product in the form of a solution. This first reaction product is then reacted with an oxirane under conditions to produce a second reaction product which is then nitrated with nitric acid under nitrating conditions to form a nitro-ester.

The starting materials used to prepare the novel ignition promoter composition are sugars. The term "sugars" as used herein include (1) water-soluble organic compounds containing a carbonyl group and several alcohol functionalities, usually from four to five alcohol functionalities, and (2) water-soluble hydrolysates of dimers, oligomers and polymers containing at least two units of the water-soluble organic compounds, for example, from two to about 14,000 units, generally from two to about 200 units. Suitable examples of water soluble organic compounds (1) include the monosaccharides such as glucose, d-mannose, d-galactose, fructose, arabinose, xylose and ribose. Suitable examples of water soluble hydrolysates (2) include disaccharides such as, for example, sucrose, galactose, and maltose, and hemicellulose and higher molecular weight polysaccharides.

The reaction is carried out using at least one sugar or in the presence of an acid catalyst. In a preferred embodiment, the selected sugar is commercially available sucrose sold as table sugar such as Domino brand (TM) sugar.

The sugar dispersion containing the acid catalyst in the solvent may be allowed to stand at room temperature. In preferred embodiments, the dispersion is heated for sufficient time to form a clear solution or liquid. The sugar can be heated at room temperature for about one minute to 24 hours at about 50–200° C. and preferably at about 50° C. to 150° C. In embodiments of the invention, the sugar dispersion is heated to 35° C. to 100° C. for about one to five hours.

In the first step of the novel process herein, one or more sugars as defined above are combined with a selected solvent in the presence of an acid catalyst. The solvents are polar solvents. Suitable solvents include water, lower alcohols including, for example, methanol, ethanol, and isopropanol, lower ketones such as acetone and methyl ethyl ketone, and mixtures thereof. The preferred solvents are methanol, acetone and mixtures thereof. The weight ratio of sugar to solvent can be, for example, in the range of 20:1 to 1:20, more preferably, 10:1 to 1:10, and most preferably, from 5:1 to 1:5.

In a preferred embodiment, the solvent is methanol substantially in the absence of water. The sugar is mixed with the methanol in an amount to form a dispersion. The dispersion is heated at elevated pressures in the presence of an acid catalyst to form a first reaction product in the form of a clear liquid.

The process of heating the sugar solution or dispersion in the presence of the acid is preferably at an elevated pressure. The heating step is preferably carried out in an autoclave at a pressure of about 50 to 100 psig and more preferably at about 75 psig. When the sugar is a disaccharide and the solvent is an alcohol, the reaction takes several hours to reach completion at atmospheric pressure. However, when the same dispersion is heated to about 100–115° C. at about 75 psig, the reaction reaches completion in about 10 minutes. In preferred embodiments, the sugar solution or dispersion is heated in an autoclave at about 100–150° C., and more preferably at about 110° C. for about 5 to 15 minutes.

The catalysts that can be employed include mineral acids such as, for example, hydrochloric and sulfuric acid and organic acids such as, for example, oxalic and p-toluenesulfonic acid.

The resulting first reaction product solution obtained from heating the sugar solution or dispersion is then reacted with an oxirane under conditions to form a polyether. The preferred oxiranes are alkylene oxides such as, for example, ethylene oxides and propylene oxide, preferably ethylene oxide. In this procedure, the desired amount of oxirane is generally added to the resulting solution, for example at ambient temperature and pressure. Heat generated by the ensuing reaction is controlled by cooling. After heat evolution ceases, excess solvent in the reaction mixture is removed therefrom, for example, by distillation under reduced pressure. The resulting product is a moderately viscous liquid at room temperature.

The weight ratio of sugar to oxirane used in the process can be, for example, in a range of about 1:10 to about 50:1, preferably from about 1:1 to about 10:1. The amount of the oxirane used is based on the starting weight of the sugar. The amount of the oxirane added is dependent on the desired properties of the final compound and the desired number of polyalkylene oxide units on the compound.

The reaction is carried out using a residence time of about one minute to about 24 hours, preferably about one to about five hours. The temperature of the reaction medium is maintained from about 0° C. to about 200° C., preferably about 35° C. to about 100° C.

In preferred embodiments, the reaction of the first reaction product with the oxirane is at ambient pressure. In alternative embodiments, the reaction may be at elevated pressures of up to about 100 psig.

The second reaction product obtained from the reaction of the sugar solution with an oxirane is then subjected to a nitration reaction using nitric acid and a suitable dehydrating agent. Suitable dehydrating agents include, for example, sulfuric acid, including oleum, anhydrous magnesium nitrate, and acetic anhydride. The aqueous nitric acid in this step can have a concentration of about 70 to about 99.8 wt %. The weight ratio of nitric acid to dehydrating agent is in the range of about 1:3 to about 2:1. In a preferred embodiment, the dehydrating agent is 96 wt % aqueous sulfuric acid.

The amount of nitric acid used relative to the reaction product being nitrated is in a stoichiometric amount to nitrate all of the available reaction cites under conditions of reaction. For example, the weight ratio of nitric acid to the reaction product can be in the range of about 10:1 to about 1:10, preferably about 5:1 to about 1:5. The nitration is carried out at a temperature in the range of about −20 to about 50° C., preferably about 0 to about 25° C., over a period of about five minutes to about five hours, preferably about 10 minutes to about two hours, at atmospheric or elevated pressure. On termination of the reaction, the reaction mixture is separated into an acid phase and a water-immiscible liquid product. The latter water-immiscible liquid is separated and repeatedly washed with water to remove residual acid. The final product is a viscous liquid of the nitro-ester. The weight percent of nitrogen in the final product can be, for example, in the range of about four to about 15 wt %, generally from about 10 to about 14 wt % based on the molecular weight of the final product.

The final nitrated compound produced by the above process is suitable for use as an ignition promoter for fuels in internal combustion engines. The nitrated compound is particularly suitable for use as an ignition promoter in alcohol and alcohol based fuels to render the fuels suitable for use in compression-ignition engines.

A fuel suitable for use in a compression-ignition engine (diesel engine) is prepared by adding the novel ignition promoter to a lower alcohol having from one to about six carbon atoms, preferably from one to about four carbon atoms, or mixtures thereof. The preferred alcohols are methanol and ethanol. The ignition promoter is added in an amount to produce a fuel containing from about 0.15 to about 30 wt %, and preferably from about 0.5 to about 20 wt % of the ignition promoter.

EXAMPLE 1

Fifty grams of granulated "Domino " brand, food grade sugar obtained in a food supermarket were combined with 25 grams of water at 25 ° C. to which one gram of oxalic acid had been added to serve as a catalyst. The resulting solution was placed into a 500 milliliter round bottom flask equipped with a stirrer and thermometer. Twenty-five grams of ethylene oxide were added to the contents of the flask over a period of one hour, resulting in a strong evolution of heat. Throughout the run, the temperature was maintained at 50° C. by cooling until heat evolution ceased. The product solution was then subjected to reduced pressure of about 30 inches of mercury in a rotary evaporator to remove water and any unreacted ethylene oxide. A viscous, colorless product weighing 75.3 grams was recovered, representing a calculated weight yield of 100%.

Twenty grams of the above liquid product was then gradually added over a period of 30 minutes to a mixture of 40 grams of 90% nitric acid and 60 grams of 96 wt % sulfuric acid in a resin kettle immersed in a cooling bath which was kept at around 15 to 20° C. After an additional 30 minutes at 25° C., the reaction mixture was poured onto ice. The water-insoluble organic produce was separated from the aqueous phase, repeatedly washed with water and then dried. The yield of dry product amounted to 28 grams for a calculated weight yield of 140%. The nitrated product obtained was analyzed and was found to contain 14.2 wt % nitrogen.

EXAMPLE 2

250 grams of "Domino " brand granulated food-grade sugar obtained in a food supermarket, 250 grams of methanol and 2.5 grams of oxalic acid were combined and stirred at about 64 ° C. (reflux temperature) for a period of 2.5 hours to obtain a clear, colorless solution. To this solution, 85 grams of ethylene oxide were gradually added over a period of one hour at ambient pressure resulting in strong evolution of heat. Throughout the run, the temperature was maintained at 50° C. by cooling until heat evolution ceased. The product solution was then subjected to reduced pressure of about 30 inches of mercury in a rotary evaporator to remove the methanol and any unreacted ethylene oxide. A viscous colorless liquid weighing 334 grams was recovered representing a calculated weight yield of 100%.

27.4 grams of the above liquid product was then gradually added over a period of 10 minutes to a mixture of 40 grams of 90% nitric acid and 60 grams of 96 wt % sulfuric acid in a resin kettle immersed in a cooling bath which was kept at around 0° C. After an additional 30 minutes at 25° C., the reaction mixture was poured onto ice. The water-insoluble organic product was separated from the aqueous phase, repeatedly washed with water and then dried. The yield of dry product weighed 30.3 grams for a calculated weight yield of 109%. The nitrated product obtained was analyzed and was found to contain 12.48 wt % nitrogen.

EXAMPLE 3

Stripper bottoms obtained as a by-product from paper making using the Alcell Process, operated by Repap, a Canadian corporation, having its head office in Montreal, Canada, were used in this example. The Alcell Process is described in Tappi Journal, Volume 74, No. 3, March 1991, by E. Kendall Pye and Jairo H. Lora. These stripper bottoms, identified as a polysaccharide stream, contain water-soluble depolymerisates of hemicelluloses.

66.6 grams of ethylene oxide were gradually added to 134.7 grams of a concentrate of the above material which contained six wt % of water and one gram of added p-toluene sulfonic acid as a catalyst. Heat evolution was controlled by cooling to maintain a temperature around 40° C. The product from this reaction was subjected to a vacuum of about 38 inches of mercury in a rotary evaporator to remove water and unreacted ethylene oxide therefrom. 187.3 grams of a dry, highly viscous product of dark brow color were recovered for a calculated weight yield of 109%.

93 grams of the above liquid product were gradually added over a period of one hour to a mixture of 209 grams of 90 wt % aqueous nitric acid and 307 grams of 96 wt % aqueous sulfuric acid in a resin kettle immersed in a cooling bath while maintaining the reaction mixture at 17° C. with stirring. The reaction mixture was kept for an additional 30 minutes at 25° C., after which it was poured onto ice. The water insoluble organic product was separated from the aqueous phase, repeatedly washed with water and then dried. The weight yield of dry nitrated product amounted to 96 grams, for a calculated weight yield of 103%. The nitrogen content was determined to be 11.82 wt %.

Examples 4 and 5 illustrate the use of other sovent systems in the first step of the process.

EXAMPLE 4

250 grams of "Domino " brand granulated food-grade sugar obtained in a food supermarket, 250 grams of ethanol and 2.5 grams of oxalic acid were combined and stirred at about 78° C. (reflux temperature) for a period of six hours after which time a clear, colorless solution was obtained. Subsequent reactions with ethylene oxide and nitric acid were then carried out as outlined in experiments 1 to 3.

EXAMPLE 5

250 grams of "Domino " brans granulated food-grade sugar obtained in a food supermarket, 244 grams of a mixture of 116 grams of acetone and 128 grams of methanol, as well as one gram of p-toluenesulfonic acid monohydrate were combined and stirred at around 55° C. for a period of two hours, after which time a clear, colorless solution was obtained. Subsequent reactions with ethylene oxide and nitric acid were then carried out as outlined in experiments 1 to 3.

Elemental analysis of some of the nitrated products obtained above are set forth in Table I below.

TABLE 1

| Weight Percent | Example 1 | Example 2 | Example 3 |
|---|---|---|---|
| Carbon | 23.64 | * | * |
| Hydrogen | 3.02 | * | * |
| Nitrogen | 14.42 | 12.48 | 11.82 |
| Oxygen | 58.92 | * | * |

*not available

EXAMPLE 6

The nitrated products obtained in Examples 1 and 2 were each tested several times, in accordance with the method used in our previous U.S. Pat. No. 5,096,462, for their expected effectiveness as ignition promoters in fuels, which their nitro-ester structure and high nitrogen content would predict. Each nitrated product was found consistently to decompose instantly in flames in the temperature range of 125° C. to 135° C. in identical fashion as the corresponding nitrated products obtained in our U.S. Pat. No. 5,096,462 and which performed well in actual internal engine combustion tests.

EXAMPLE 7

100 grams of "Domino " brand granulated food-grade sugar obtained in a food supermarket, 64 grams methanol, 58 grams acetone and 0.5 grams of oxalic acid were combined and stirred in a 250 ml autoclave at 112° C. for 10 minutes maintaining its pressure at 75 psig. The product solution was water-white and identical to that obtained at atmospheric pressure when heated for several hours. The resulting product was reacted with ethylene oxide and nitrated to form the nitro-ester using the method described in Examples 1 and 2.

EXAMPLE 8

100 grams of "Domino " brand granulated food-grade sugar obtained in a food supermarket, 64 grams methanol, 58 grams acetone and 0.5 grams of oxalic acid were combined and stirred in a 250 ml autoclave at 112° C. for 60 minutes maintaining its pressure at 75 psig. The product solution was water-white and identical to that obtained at atmospheric pressure when heated for several hours. The resulting reaction product was reacted with ethylene oxide and subsequently nitrated to form the nitro-ester using the method described in Examples 1 and 2.

EXAMPLE 9

100 grams of "Domino " brand granulated food-grade sugar obtained in a food supermarket, 100 grams methanol, 1 gram of oxalic acid were combined and stirred in a 250 ml autoclave at 110° C. for 10 minutes maintaining its pressure at 75 psig. The product solution was water-white and identical to that obtained at atmospheric pressure and methanol reflux at atmospheric pressure for several hours. The resulting reaction product was reacted with ethylene oxide and subsequently nitrated to form the nitro-ester using the method described in Examples 1 and 2.

EXAMPLE 10

100 grams of "Domino " brand granulated food-grade sugar obtained in a food supermarket, 100 grams methanol were combined and stirred in a 250 ml autoclave at 110 ° C. for 60 minutes without catalyst maintaining a pressure of 75 psig during the run. There was no solubilization.

Many modifications and variations of the invention, as hereinabove set forth, can be made without departing from the spirit and scope thereof, and therefore only such limitations should be imposed as are indicated in the appended claims.

What is claimed is:

1. A process for preparing an ignition promoter comprising:

forming a dispersion of a sugar in methanol or ethanol in the presence of an acid catalyst;

heating said dispersion at a sufficient temperature to form a first reaction product solution;

reacting said first reaction product with an oxirane to form a second reaction product;

recovering the second reaction product;

nitrating said recovered second reaction product to produce a nitro-ester compound; and recovering said nitro-ester compound.

2. The process of claim 1, wherein the step of heating said dispersion of said sugar and solvent occurs at a temperature of about 25 to 200° C. in the presence of said acid catalyst.

3. The process of claim 1, wherein the step of reacting said oxirane with said first reaction product occurs at a temperature of about 0° C.–200° C. for about one minute to 24 hours.

4. The process of claim 1, wherein said nitration reaction comprises adding aqueous nitric acid having a concentration of about 70–99.8% by weight, in the presence of a dehydrating agent.

5. The process of claim 1, wherein said nitration reaction comprises nitrating said recovered second reaction product at about −20° C. to 50° C. for about five minutes to about five hours.

6. The process of claim 1, wherein said sugar is a disaccharide.

7. The process of claim 6, wherein said disaccharide is sucrose.

8. The process of claim 1, wherein the step of heating said sugar dispersion occurs at a temperature of about 50° C. to 150° C. in the presence of said acid catalyst.

9. The process of claim 1, wherein the step of reacting said oxirane with said first reaction product occurs at a temperature of about 35° C. to 100° C. for about 1–5 hours.

10. The process of claim 1, wherein the step of dispersing said sugar in said solvent and heating said dispersion occurs at an elevated pressure to about 50° C. to 200° C.

11. The process of claim 10, wherein the step of heating said dispersion at said elevated pressure occurs for about 5 to 15 minutes.

12. The process of claim 10, wherein said heating step comprises heating said dispersion at a pressure of about 50–100 psig.

13. The process of claim 1, wherein said sugar is selected from the group consisting of glucose, d-mannose, d-galactose, fructose, arabinose, xylose, ribose, sucrose, maltose, and hemicellulose.

14. A process for preparing an ignition promoter comprising:

forming a dispersion of a sugar in the presence of an acid catalyst in a polar medium selected from the group consisting of lower alcohols and lower ketones;

heating said dispersion at a sufficient temperature to form a first reaction product solution;

reacting said first reaction product solution with an oxirane to form a second reaction product;

recovering the second reaction product;

nitrating said recovered second reaction product to produce a nitro-ester compound; and recovering said nitro-ester compound.

15. The process of claim 14, wherein said polar medium is selected from the group consisting of methanol, ethanol, propanol, acetone, and methyl ethyl ketone.

16. An ignition promoter compound prepared by the process of:

forming a dispersion of a sugar in a lower alcohol or lower ketone in the presence of an acid catalyst;

heating said dispersion to a temperature of about 50° C. to 200° C. to form a first reaction product solution;

reacting said first reaction product with an oxirane to form a second reaction product;

recovering said second reaction product;

nitrating said recovered second reaction product to produce a nitro-ester compound; and recovering said nitro-ester compound.

17. The ignition promoter of claim 16, wherein said lower alcohol or lower ketone is selected from the group consisting of methanol, ethanol, propanol, acetone, methyl ethyl ketone, and mixtures thereof.

18. The ignition promoter of claim 16, wherein heating said dispersion occurs at a pressure of about 50–100 psig.

19. The ignition promoter of claim 16, wherein said sugar is selected from the group consisting of glucose, d-mannose, d-galactose, fructose, arabinose, xylose, ribose, sucrose, maltose, and hemicellulose.

20. A fuel for an internal combustion engine comprising at least one $C_1$–$C_6$ alkyl alcohol; and an ignition promoter prepared by the process of:

forming a dispersion of a sugar in a lower alcohol, lower ketone or mixture thereof in the presence of an acid catalyst;

heating said dispersion at a sufficient temperature to form a first reaction product solution;

reacting said first reaction product with an oxirane to form a second reaction product;

recovering said second reaction product;

nitrating said recovered second reaction product to produce a nitro-ester compound; and recovering said nitro-ester compound.

21. The fuel of claim 20, wherein said lower alcohol is a $C_1$–$C_4$ alcohol.

22. The fuel of claim 20, wherein said polar solvent is an alkyl alcohol selected from the group consisting of methanol, ethanol and mixtures thereof.

23. The fuel of claim 20, comprising 0.15 to 30 wt % of said ignition promoter.

24. The fuel of claim 20, comprising 0.5 to 20.0 wt % of said ignition promoter.

25. The fuel of claim 20, wherein said sugar is a disaccharide and said process of producing said ignition promoter comprises heating said dispersion of said sugar and said acid at a temperature of about 50° C. to 200° C. and at a pressure of about 50 to 100 psigi reacting said first reaction product solution with an oxirane to form a second reaction product;

recovering said second reaction product;

nitrating said recovered second reaction product to produce a nitro-ester compound; and recovering said nitro-ester compound.

* * * * *